US009666138B2

(12) United States Patent
Muguruma et al.

(10) Patent No.: US 9,666,138 B2
(45) Date of Patent: May 30, 2017

(54) DISPLAY DRIVING METHOD TO DRIVE A DISPLAY BASED ON DISPLAY DATA WITH RESPECT TO A DISPLAY UNIT INCLUDING PIXEL ARRANGED AT DATA AND SCAN LINE INTERSECTIONS, AND CORRESPONDING DISPLAY DRIVING DEVICE AND DISPLAY APPARATUS

(71) Applicant: FUTABA CORPORATION, Mobara-shi, Chiba-ken (JP)

(72) Inventors: Takashi Muguruma, Mobara (JP); Terukazu Sugimoto, Mobara (JP); Keisuke Kawana, Mobara (JP); Yukio Kamiyama, Mobara (JP); Kazuhiro Iwata, Mobara (JP)

(73) Assignee: FUTABA CORPORATION, Mobara-Shi (JP)

( * ) Notice: Subject to any disclaimer, the term of this patent is extended or adjusted under 35 U.S.C. 154(b) by 96 days.

(21) Appl. No.: 14/568,175

(22) Filed: Dec. 12, 2014

(65) Prior Publication Data

US 2015/0170612 A1 Jun. 18, 2015

(30) Foreign Application Priority Data

Dec. 16, 2013 (JP) ..... 2013-259168

(51) Int. Cl.
*G09G 3/30* (2006.01)
*G09G 3/3283* (2016.01)
(Continued)

(52) U.S. Cl.
CPC ..... *G09G 3/3283* (2013.01); *G09G 3/3216* (2013.01); *G09G 3/3275* (2013.01);
(Continued)

(58) Field of Classification Search
CPC .. G09G 3/3283; G09G 3/3216; G09G 3/3275; G09G 3/3685
(Continued)

(56) References Cited

U.S. PATENT DOCUMENTS

2003/0184237 A1 10/2003 Togashi et al.
2004/0100459 A1* 5/2004 Wu ..... G09G 3/32 345/204
(Continued)

FOREIGN PATENT DOCUMENTS

CN 1801296 A 7/2006
JP H05-083686 A 4/1993
(Continued)

OTHER PUBLICATIONS

Japanese Office Action dated Jan. 19, 2016 issued in corresponding Japanese Japanese Patent Application No. 2013-259168 and English translation thereof.
(Continued)

*Primary Examiner* — Adam J Snyder
(74) *Attorney, Agent, or Firm* — Bacon & Thomas, PLLC

(57) ABSTRACT

A display driving device performs display drive based on display data with respect to a display unit including pixels arranged at respective intersections of data lines and scanning lines. The device includes: a current setting unit configured to store current gradation values which are set for the respective scanning lines that constitute a frame of the display data; a current gradation control unit configured to, at each of scan timings for the respective scanning lines within one frame, generate a constant current corresponding to a current gradation value for a corresponding scanning line among the current gradation values stored in the current setting unit; and a data line driving unit configured to supply the constant current generated by the current gradation
(Continued)

control unit to the respective data lines for time periods corresponding to pixel gradation values defined by the display data.

12 Claims, 12 Drawing Sheets

(51) Int. Cl.
*G09G 3/36* (2006.01)
*G09G 3/3216* (2016.01)
*G09G 3/3275* (2016.01)
*G09G 3/10* (2006.01)

(52) U.S. Cl.
CPC ... *G09G 3/3685* (2013.01); *G09G 2300/0426* (2013.01); *G09G 2310/0243* (2013.01); *G09G 2310/0272* (2013.01); *G09G 2310/0291* (2013.01)

(58) Field of Classification Search
USPC ..... 345/76; 315/169.3
See application file for complete search history.

(56) References Cited

U.S. PATENT DOCUMENTS

2004/0155840 A1* 8/2004 Abe ..... G09G 3/3283 345/76
2004/0178742 A1* 9/2004 Date ..... G09G 3/3283 315/169.3
2004/0263087 A1* 12/2004 Maede ..... G09G 3/3283 315/169.3
2005/0231241 A1* 10/2005 Date ..... G09G 3/3283 327/108
2005/0248328 A1* 11/2005 Yang ..... G09G 3/3283 323/312
2006/0066263 A1 3/2006 Okuyama et al.
2006/0145966 A1* 7/2006 Adachi ..... G09G 3/3216 345/76
2007/0097040 A1 5/2007 Miyazawa
2007/0211043 A1* 9/2007 Furuichi ..... G09G 3/3283 345/204
2009/0066260 A1* 3/2009 Sugimoto ..... G09G 3/22 315/169.3
2010/0141690 A1* 6/2010 Arai ..... G09G 3/3283 345/690

FOREIGN PATENT DOCUMENTS

JP 2000-105574 A 4/2000
JP 2003-288053 A 10/2003
JP 2003-323145 A 11/2003
JP 2006-189645 A 7/2006
KR 10-2006-0051570 A 5/2006
KR 10-2007-0047218 A 5/2007

OTHER PUBLICATIONS

Korean Office Action dated Sep. 30, 2015 issued in corresponding Korean Patent Application No. 10-2014-0180742 and English translation thereof.
Taiwanese Office Action dated Apr. 6, 2016, including search report, issued in corresponding Taiwanese Patent Application No. 103143681 and English translation thereof.
Korea Office Action dated Apr. 29, 2016 issued in corresponding Korean Patent Application No. 10-2014-0180742 and English translation thereof.
Chinese Office Action dated Sep. 2, 2016, including search report, issued in corresponding Chinese Patent Application No. 201410781466.X and English translation thereof.
Japanese Office Action dated Aug. 30, 2016, issued in corresponding Japanese Patent Application No. 2013-259168 and English translation thereof.

* cited by examiner

*FIG. 6*

| TIMING | CURRENT GRADATION VALUE | REGISTER VALUE | | | | | |
|---|---|---|---|---|---|---|---|
| | | R1 | R2 | R3 | R4 | R5 | R6 |
| L1 | 3Fh (63) | 1 | 1 | 1 | 1 | 1 | 1 |
| L2 | 3Ch (60) | 0 | 0 | 1 | 1 | 1 | 1 |
| L3 | 3Fh (63) | 1 | 1 | 1 | 1 | 1 | 1 |
| L4 | 3Ch (60) | 0 | 0 | 1 | 1 | 1 | 1 |
| ⋮ | ⋮ | ⋮ | ⋮ | ⋮ | ⋮ | ⋮ | ⋮ |
| L96 | 3Fh (63) | 1 | 1 | 1 | 1 | 1 | 1 |

DISPLAY DRIVING METHOD TO DRIVE A DISPLAY BASED ON DISPLAY DATA WITH RESPECT TO A DISPLAY UNIT INCLUDING PIXEL ARRANGED AT DATA AND SCAN LINE INTERSECTIONS, AND CORRESPONDING DISPLAY DRIVING DEVICE AND DISPLAY APPARATUS

CROSS-REFERENCE TO RELATED APPLICATION

This application claims priority to Japanese Patent Application No. 2013-259168 filed on Dec. 16, 2013, the entire contents of which are incorporated herein by reference.

FIELD OF THE INVENTION

The present invention relates to a display driving device, a display driving method and a display apparatus. More particularly, the present invention relates to a technology for driving a display unit in which a plurality of data lines and a plurality of scanning lines are provided and in which pixels are arranged at intersections of the data lines and the scanning lines.

BACKGROUND OF THE INVENTION

As display panels for displaying an image, there are known a display apparatus that makes use of an OLED (Organic Light Emitting Diode) and a display apparatus that makes use of an LCD (Liquid Crystal Display). Many display apparatuses include a display unit in which data lines each connected to a plurality of pixels arranged in a column direction and scanning lines each connected to a plurality of pixels arranged in a row direction are disposed and in which the pixels are arranged at intersections of the data lines and the scanning lines.

In the case of so-called line sequential scanning, a scanning line driver sequentially selects scanning lines, and a data line driver outputs a data line drive signal for one scanning line to each data line, whereby the display of each dot, i.e., each pixel is controlled.

Japanese Patent Application Publication No. H9-232074 discloses a technology in which, in order to improve the delay in the rise of pixel light emission attributable to the parasitic capacitance of a display panel, all scanning lines are connected to a reset potential when scanning is shifted to the next scanning line. Japanese Patent Application Publication No. 2004-309698 discloses a technology in which all electrodes are connected to a reset potential and then to a preset potential, as a method for reducing overshoot or undershoot when a display signal is supplied to a data electrode.

For example, in a passively-driven OLED display apparatus, in the case where scanning lines having different lengths exist in a display panel due to the shape of the display panel different than a typical rectangular shape or in the case where the lighting ratio of pixels (the number of lighted pixels) differs in respective scanning lines, there may be a case where the luminance partially becomes higher or lower than the original gradation. As a result, display unevenness is generated on a screen. The term "lighting ratio" referred to herein means the ratio of the number of emitted pixels to the total number of pixels in each of the scanning lines. The lighting ratio is given by an equation:

(lighting ratio=the number of emitted pixels on a scanning line/the total number of pixels on a scanning line)

SUMMARY OF THE INVENTION

In view of the above, the present invention provides a display driving device, a display driving method and a display apparatus which are capable of reducing luminance unevenness (display unevenness) by decreasing a luminance variation generated under the aforementioned circumstances.

In accordance with a first aspect of the present invention, there is provided a display driving device for performing display drive based on display data with respect to a display unit which includes data lines each connected to a plurality of pixels arranged in a column direction and scanning lines each connected to a plurality of pixels arranged in a row direction, the pixels arranged at respective intersections of the data lines and the scanning lines, the device including: a current setting unit configured to store current gradation values which are set for the respective scanning lines that constitute a frame of the display data; a current gradation control unit configured to, at each of scan timings for the respective scanning lines within one frame, generate a constant current corresponding to a current gradation value for a corresponding scanning line among the current gradation values stored in the current setting unit; and a data line driving unit configured to supply the constant current generated by the current gradation control unit to the respective data lines for time periods corresponding to pixel gradation values defined by the display data.

With this display driving device, the constant current is applied to the data lines for the time periods corresponding to the gradation values. The light emission luminance of the pixels is controlled depending on the application time of the constant current. There may be a case where, due to the influence of the number of non-emitted pixels existing on one scanning line or the influence of the light emission gradation or due to the difference in the lengths of the respective scanning lines, the luminance partially becomes higher or lower than the original gradation, thereby generating luminance unevenness. In view of this, the value of the constant current applied to the respective data lines is controlled at each of the scan timings of the respective scanning lines. That is to say, the constant current is variably controlled every time when one scanning line is scanned. The constant current value for each of the scanning line is set and stored as a suitable current gradation value capable of removing luminance unevenness.

Further, in the display driving device, the current gradation control unit may perform switching of the current gradation values during a blanking period between scan periods of the respective scanning lines.

The constant current value is controlled on a line-by-line basis. By performing the switching of the constant current value during the blanking period, it is possible to prevent the fluctuation of the constant current from affecting the display.

Further, in the display driving device, the current gradation values stored in the current setting unit may be set to be rewritten in response to a switching of the display data displayed on the display unit.

The lighting ratios of the respective scanning lines within one frame vary depending on the image content. Accordingly, when switching the displayed image, it is preferable to rewrite the current gradation values stored in the current setting unit.

Further, in the display driving device, rewriting of the current gradation values stored in the current setting unit may be performed at a frame start timing.

This is for performing the switching of the displayed image at the frame start timing.

Further, in the display driving device, the current gradation control unit may select one or more transistors having differently-weighted current values based on the current gradation value for the corresponding scanning line and may generate, as the constant current corresponding to the current gradation value, a current equal to a total sum of current values flowing in the selected transistors.

By selecting the transistor depending on the current gradation values, it is possible to perform the constant current driving depending on the current gradation values.

In accordance with a second aspect of the present invention, there is provided a display driving method for performing display drive based on display data with respect to the display unit, the method including: storing current gradation values which are set for the respective scanning lines that constitute a frame of the display data; generating, at each of scan timings for the respective scanning lines within one frame, a constant current corresponding to a current gradation value for a corresponding scanning line among the stored current gradation values; and supplying the generated constant current to the respective data lines for time periods corresponding to pixel gradation values defined by the display data.

Accordingly, the correction of the luminance unevenness against the luminance variation attributable to the difference in the lengths of the scanning lines or the difference in the lighting ratios on the scanning lines is realized by adjusting the value of the constant current applied to the data lines at each of the scan timings.

In accordance with a third aspect of the present invention, there is provided a display apparatus including: a display unit including data lines each connected to a plurality of pixels arranged in a column direction and scanning lines each connected to a plurality of pixels arranged in a row direction, the pixels arranged at respective intersections of the data lines and the scanning lines; a scanning line driving unit configured to apply a scanning line drive signal to the scanning lines; a current setting unit configured to store current gradation values which are set for the respective scanning lines that constitute a frame of display data; a current gradation control unit configured to, at each of scan timings for the respective scanning lines within one frame, generate a constant current corresponding to a current gradation value for a corresponding scanning line among the current gradation values stored in the current setting unit; and a data line driving unit configured to supply the constant current generated by the current gradation control unit to the respective data lines for time periods corresponding to pixel gradation values defined by the display data.

That is to say, the display apparatus is provided with the aforementioned display driving device.

In accordance with the present embodiment, the luminance variation attributable to the difference in the lengths of the scanning lines or the lighting ratios of pixels on the scanning lines is reduced by adjusting the value of the constant current applied to the data lines, at each of the scan timings. This makes it possible to reduce display unevenness (luminance unevenness), consequently improving the display quality.

BRIEF DESCRIPTION OF THE DRAWINGS

The objects and features of the present invention will become apparent from the following description of embodiments, given in conjunction with the accompanying drawings, in which:

FIG. 6 is an explanatory view of the current gradation values in accordance with the embodiment;

DETAILED DESCRIPTION OF THE EMBODIMENTS

Hereinafter, an embodiment of the present invention will now be described in the following order.

1. Display Apparatus in accordance with an Embodiment
2. Description on Luminance Variation generated on Display
3. Configuration and Operation of Display Driving Device
4. Switching of Displayed Image
5. Effects of the Embodiment and Modified Examples (1. Display Apparatus in accordance with an Embodiment FIG. 1 shows a display apparatus 1 according to an embodiment and an MPU (Micro Processing Unit) 2 for controlling a display operation of the display apparatus 1.

The display apparatus 1 includes a display unit 10 which constitutes a display screen, a controller IC (Integrated Circuit) 20 and a cathode driver 21.

The display apparatus 1 corresponds to a display apparatus defined in the claims. The controller IC 20 corresponds to a display driving device defined in the claims.

Figure 1:
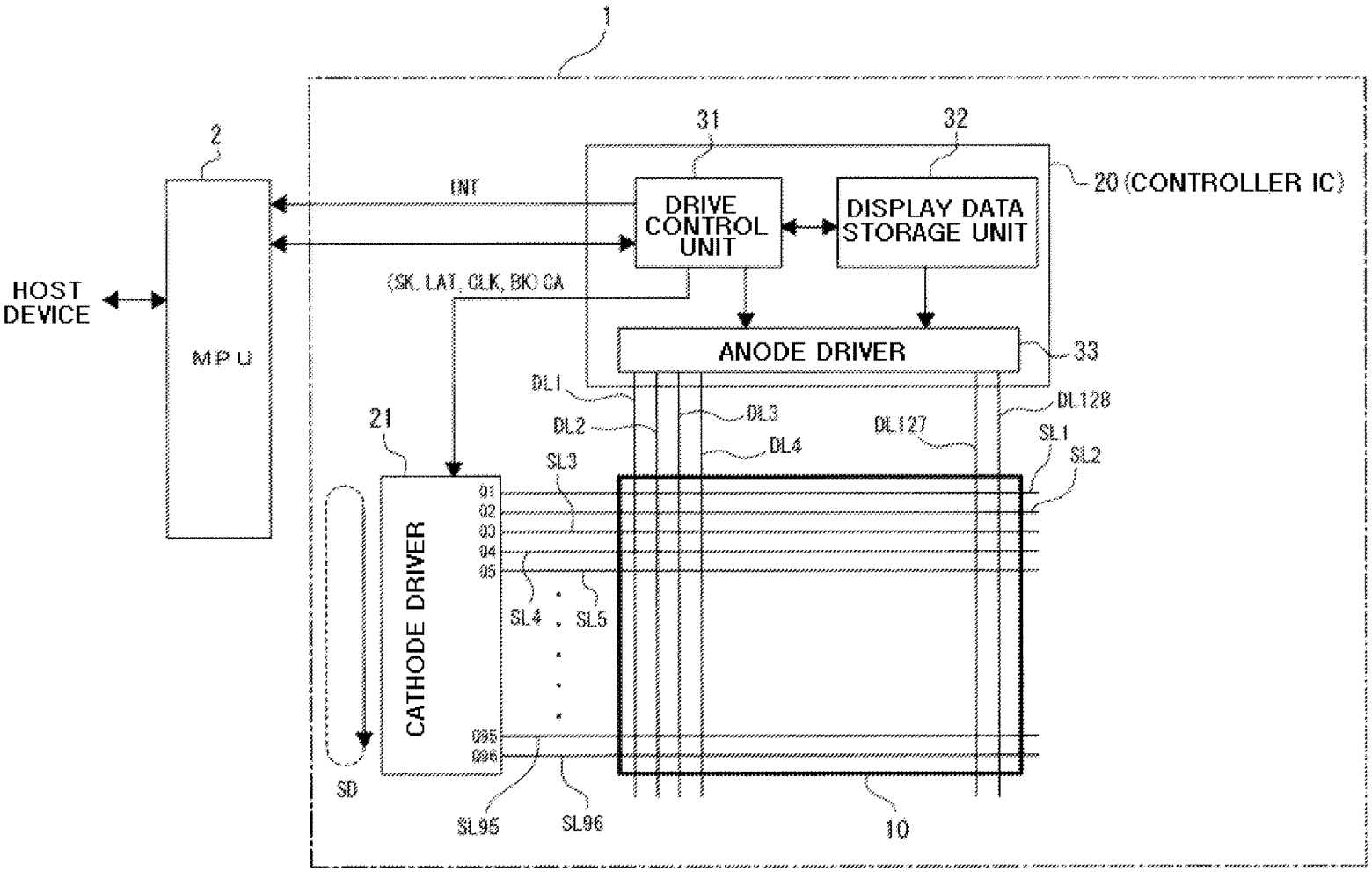
FIG. 1 is a block diagram of a display apparatus in accordance with an embodiment of the present invention.

In the example shown in FIG. 1, the cathode driver 21 is provided outside the controller IC 20. Alternatively, the cathode driver 21 may be provided within the controller IC 20.

In the display unit 10, there are disposed data lines DL (DL1 to DL128) and scanning lines SL (SL1 to SL96). Pixels are arranged at the respective intersections of the data lines DL and the scanning lines SL. Specifically, in a corresponding relationship with the 128 data lines DL1 to DL128 and the 96 scanning lines SL1 to SL96, 128 pixels are disposed in each horizontal line (row) and 96 pixels are disposed in each vertical line (column).

Accordingly, the display unit 10 includes 12288 (128×96) pixels which constitute a displayed image. In the present embodiment, each pixel is formed of a self-luminous element which makes use of an OLED. Needless to say, the number of pixels, the number of data lines and the number of scanning lines are nothing more than one example.

Each of the 128 data lines DL1 to DL128 is connected to the 96 pixels arranged in the column direction (vertical direction) in the display unit 10. Each of the 96 scanning lines SL1 to SL96 is connected to the 128 pixels arranged in the row direction (horizontal direction).

A light-emission drive current based on display data (pixel gradation values) is applied from the data lines DL to 128 pixels existing on a selected scanning line SL, whereby the 128 pixels of the selected scanning line are driven to emit light at the luminance (gradation) corresponding to the display data.

The controller IC 20 and the cathode driver 21 are provided for the purpose of display drive of the display unit 10.

The controller IC 20 includes a drive control unit 31, a display data storage unit 32 and an anode driver 33. The anode driver 33 drives the data lines DL1 to DL128.

The anode driver 33 supplies a constant current, which is supplied from the drive control unit 31, to the data lines DL for time periods corresponding to the gradations of the display data stored in the display data storage unit 32. That is to say, the anode driver 33 serves as a data line driving unit.

The drive control unit 31 performs communication of a command and display data with the MPU 2, thereby controlling a display operation pursuant to the command. For example, upon receiving a display start command, the drive control unit 31 performs timing setting pursuant to the display start command and causes the cathode driver 21 to start scanning of the scanning lines SL. Furthermore, the drive control unit 31 causes the anode driver 33 to perform the driving of the data lines DL in synchronism with the scanning performed by the cathode driver 21.

As for the driving of the data lines DL performed by the anode driver 33, the drive control unit 31 causes the display data storage unit 32 to store the display data received from the MPU 2 and transmits the display data to the anode driver 33 in conformity with the scanning timing. Moreover, the drive control unit 31 generates a constant current as a data line drive signal and supplies the constant current to the anode driver 33.

In response, the anode driver 33 outputs the constant current as a data line drive signal to the data lines DL for time periods corresponding to the respective gradations.

By virtue of this control, the respective pixels on the selected scanning line, i.e., one scanning line SL to which a scanning line drive signal of selected level is applied from the cathode driver 21, are driven to emit light. The respective scanning lines are sequentially driven to emit light, whereby frame image display is realized.

The cathode driver 21 serves as a scanning line driving unit that applies a scanning line drive signal to one end of the scanning line SL.

Output terminals Q1 to Q96 of the cathode driver 21 are connected to the scanning lines SL1 to SL96, respectively. As indicated by a scanning direction SD, a scanning line drive signal of a selected level is outputted sequentially from the output terminals Q1 to Q96, so that scanning is performed so as to sequentially select the scanning lines SL1 to SL96.

In order to perform this scanning, the drive control unit 31 supplies cathode driver control signals CA to the cathode driver 21.

The cathode driver control signals CA comprehensively indicate various kinds of signals for the scanning control. In the present embodiment, the cathode driver control signals CA include a scan signal SK, a latch signal LAT, a clock signal CLK and a blanking signal BK.

While not described in detail, the cathode driver 21 includes a shift register (not shown) installed therein. The shift register transmits, based on the clock signal CLK, a signal of selected level applied as the scan signal SK from each of the output terminals Q1 to Q96, sequentially from the output terminal Q1 to the output terminal Q96. The outputs of the shift register are latched to a latch circuit (not shown) by the latch signal LAT. The outputs of the latch circuit go through a drive circuit (not shown) and are outputted from the output terminals Q1 to Q96 to the respective scanning lines SL1 to SL96.

By virtue of this operation, the cathode driver 21 performs scanning to sequentially select the scanning lines SL1 to SL96.

The blanking signal BK is a signal that defines a timing at which the pixels are not driven to emit light.

The drive control unit 31 of the controller IC 20 outputs a frame start signal INT. The frame start signal INT is a signal which is generated at a scan timing of a first scanning line in each frame. The frame start signal INT is used within the drive control unit 31 and is also supplied to the MPU 2 as a signal indicative of the frame start timing.

(2. Description on Luminance Variation generated on Display)

In the present embodiment, in order to remove the luminance unevenness generated on a display, the anode driver 33 is configured to variably control a constant current applied to the respective data lines DL, at a scan timing of each of the scanning lines.

In this regard, the luminance unevenness generated on a display will be described. The luminance unevenness is largely divided into luminance unevenness generated due to the variant panel and luminance unevenness generated due to a lighting ratio.

Figure 2A:
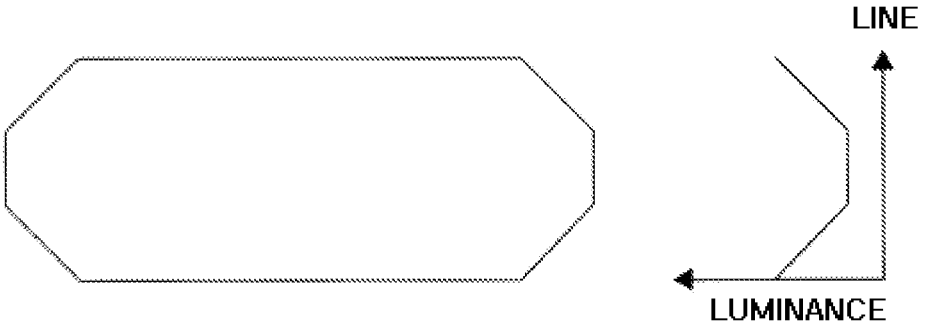
FIGS. 2A to 2C are explanatory views of the luminance unevenness in variant panels.
Figure 2B:
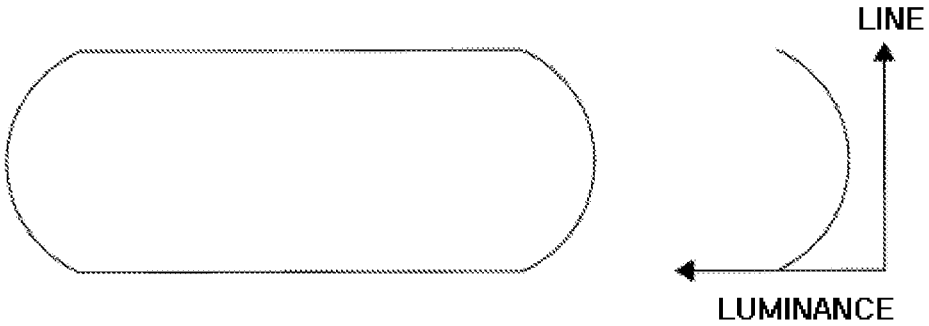
Figure 2C:
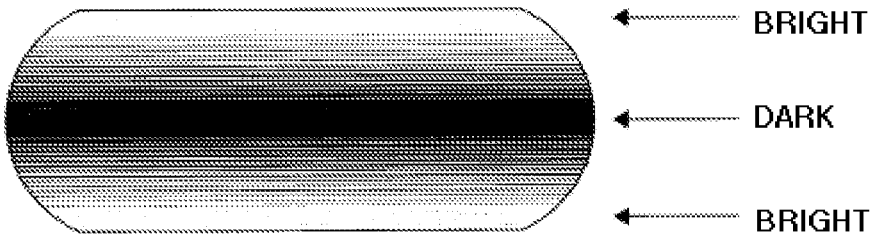

First, the luminance unevenness generated due to the variant panel will be described with reference to FIGS. 2A to 2C. FIGS. 2A and 2B show examples of the variant panel in which the display unit 10 is formed of a different shape of panel rather than a typical rectangular panel. In FIGS. 2A and 2B, there are illustrated an octagonal panel and an oblong panel. While not shown in the drawings, it is considered to use a circular panel, an elliptical panel or other polygonal panels.

In these different shapes of panels, a difference exists in the lengths of the respective scanning lines SL. As the scanning lines SL grow longer, the capacitive load and the wiring resistance become larger. A current supplied to the data lines DL flows to the scanning lines SL through the pixels. Thus, the current applied to the pixels is affected by the length of the scanning lines SL.

As a consequence, as shown in the right sides of FIGS. 2A and 2B, the luminance becomes higher in a region where the scanning lines SL are short, and the luminance becomes lower in a region where the scanning lines SL are long, even if the entire surface is driven under the drive condition of the same luminance. FIG. 2C schematically shows a situation where the luminance unevenness is generated.

Next, the luminance unevenness due to the difference in the lighting ratio, which is generated even in a display panel having a typical rectangular shape, will be described with reference to FIGS. 3 and 4.

Figure 3A:
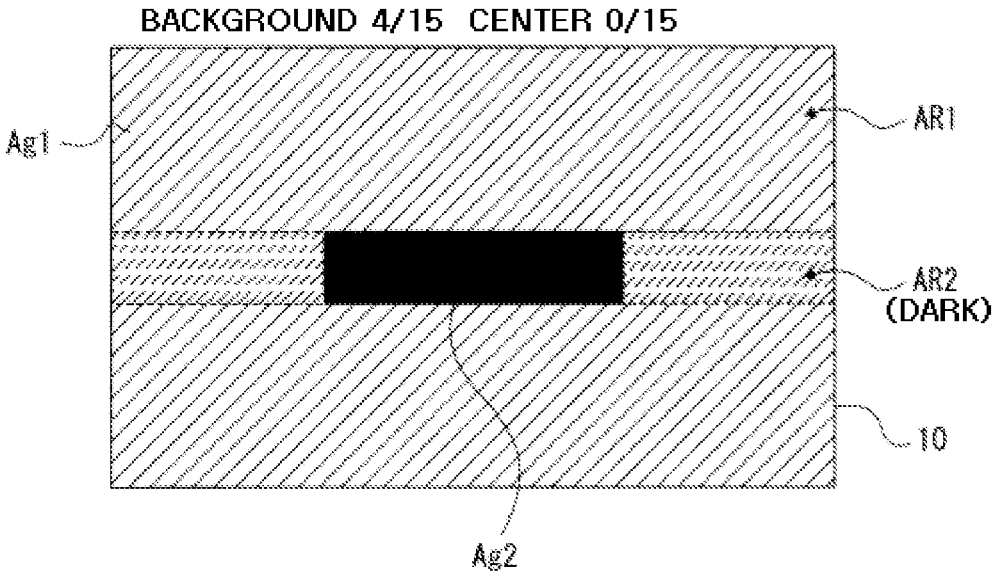
FIGS. 3A and 3B are explanatory views of the luminance unevenness attributable to the difference in the lighting ratios.

FIG. 3A shows the appearance of a display screen of the display unit 10. In this example, display is performed such that the luminance of a background region Ag1 is at 4/15 gradation and the luminance of a central region Ag2 is at 0/15 gradation (not lighted). That is to say, in the scanning lines passing through the central region Ag2, the number of lighted pixels among the total pixels on the scanning lines is small (The lighting ratio is low). The gradations of the luminance are, e.g., 16 gradations ranging from 0/15 (non-light emission) to 15/15 (maximum luminance light emission).

For example, if the pixels in the central region Ag2 are set not to emit light and the pixels in the background region Ag1 are set to emit light at a luminance of relatively low gradation, there is generated a phenomenon that the luminance of regions AR1 in the background region Ag1 and the luminance of regions AR2 in the background region Ag1 become different from each other. Specifically, the luminance of the regions AR2 indicated by broken lines (the left and right regions of the central region Ag2) becomes lower than the luminance of the remaining background region. As a result, luminance unevenness is generated.

Figure 3B:
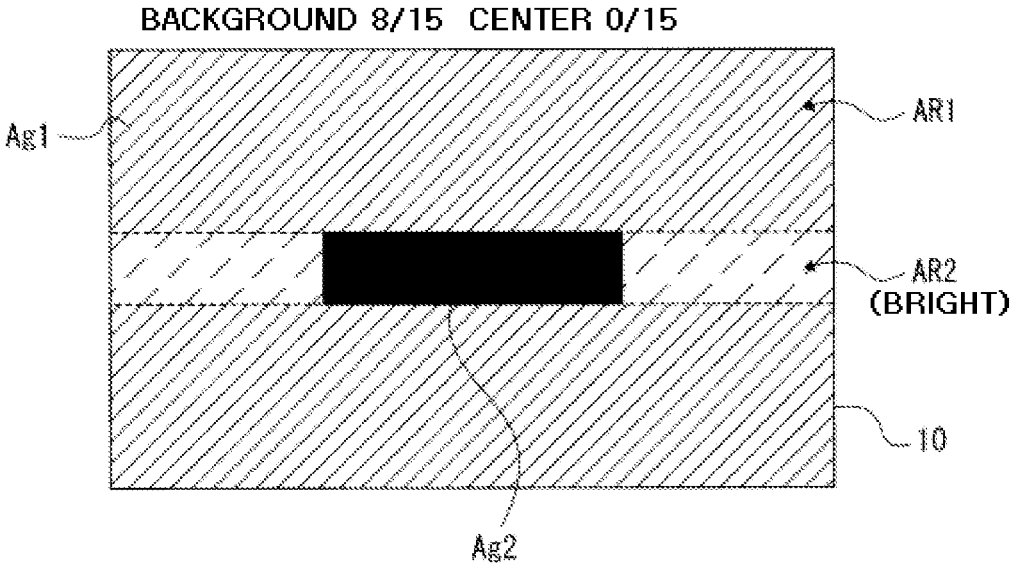

FIG. 3B shows a state in which display is performed such that the luminance of the background region Ag1 is at 8/15 gradation and the luminance of the central region Ag2 is at 0/15 gradation (not lighted). Just like FIG. 3A, the scanning lines passing through the central region Ag2 have a low lighting ratio.

For example, if the pixels in the central region Ag2 are set not to emit light and the pixels in the background region Ag1 are set to emit light at a luminance of relatively high gradation, the luminance of the regions AR1 in the background region Ag1 and the luminance of the regions AR2 in the background region Ag1 become different from each other. In this case, the luminance of the regions AR2 indicated by broken lines (the left and right regions of the central region Ag2) becomes higher than the luminance of the remaining background region. As a result, luminance unevenness is generated.

Presumably, the causes of such luminance unevenness are as follows.

Figure 4A:
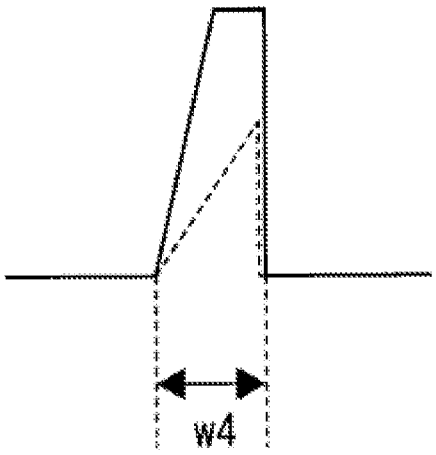
FIGS. 4A to 4D are explanatory views of the luminance unevenness generation causes attributable to the difference in the lighting ratios.
Figure 4B:
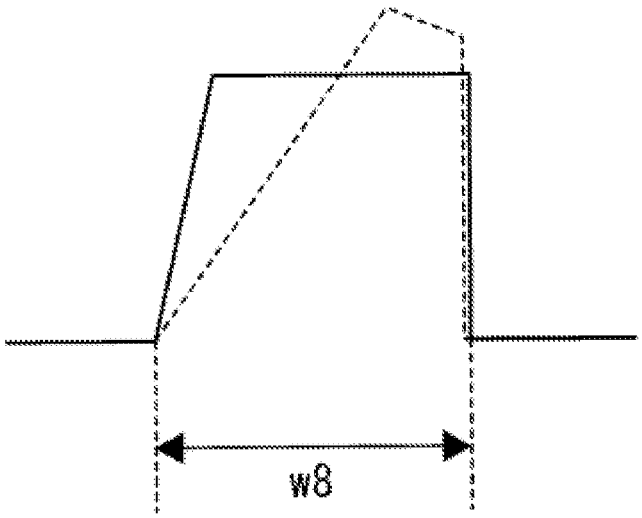
Figure 4C:
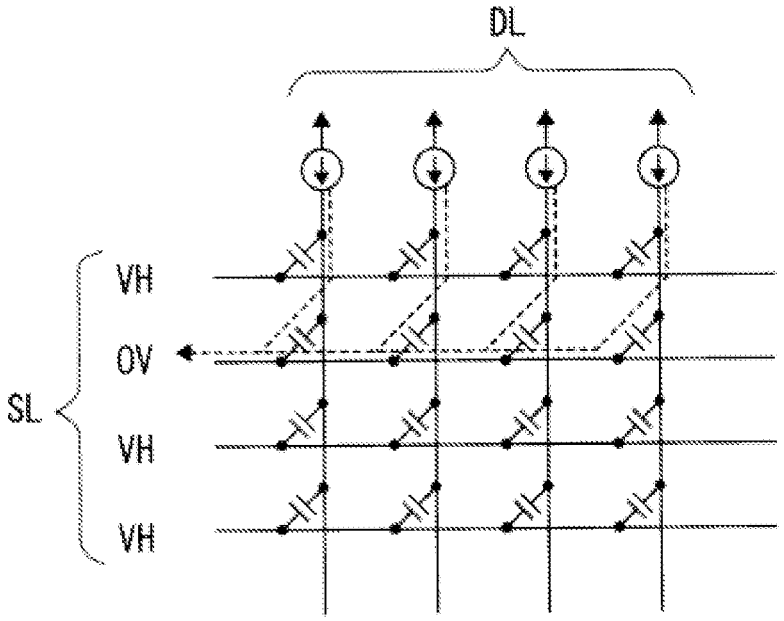

FIG. 4C shows a model of a scanning line having high lighting ratio. In FIG. 4C, there is shown a state in which a light-emitting drive current is applied to all the data lines DL. The scanning lines SL of voltage VH are in a non-selection state and the scanning line SL of voltage 0 V is a selected line. In this case, a current applied to the respective data lines flows through the selected scanning line SL as indicated by broken lines.

Figure 4D:
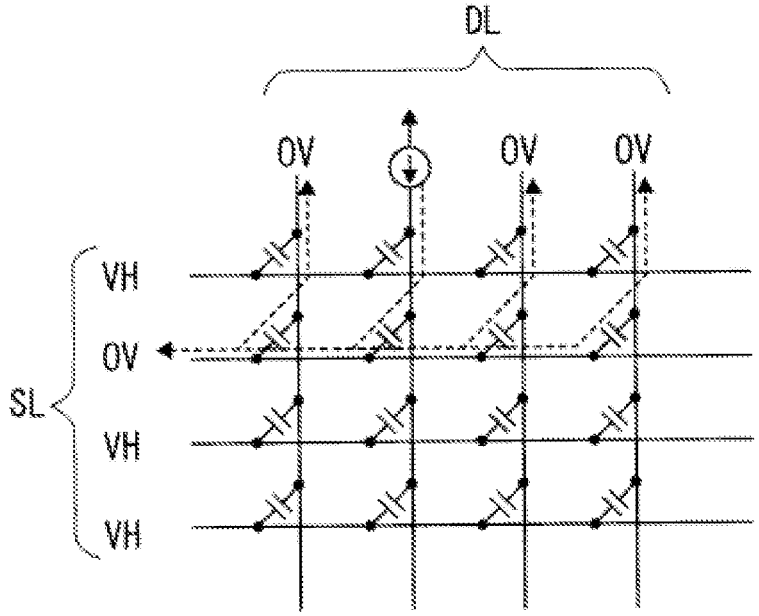

FIG. 4D shows a model of a scanning line having low lighting ratio. In FIG. 4D, there is shown a state in which a current is applied to one data line DL and the remaining data lines are kept at 0 V (e.g., grounded).

In this case, the current applied to the data line DL corresponding to the lighted pixels flows through not only the selected scanning line SL but also the data lines DL corresponding to the non-lighted pixels. For that reason, charging is performed with respect to the parasitic capacitance of the non-lighted pixels among the capacitance components of the respective pixels indicated by a capacitor symbol. Thus, the load is increased. Consequently, there is generated an event that the rise of the light-emitting drive current is delayed.

In view of the foregoing, if the luminance of the background region Ag1 is relatively low as shown in FIG. 3A, the light-emitting drive current applied to the pixels of the region AR1 has a waveform indicated by a solid line in FIG. 4A and the light-emitting drive current applied to the pixels of the region AR2 has a waveform indicated by a broken line in FIG. 4A.

Specifically, the light-emitting drive current applied to the pixels of the scanning lines having a high lighting ratio rises fast and the light-emitting drive current applied to the pixels of the scanning lines having a low lighting ratio rises slow.

In this regard, the time period w4 of applying the constant current is, e.g., the length in the 4/15 gradation. As can be noted from this waveform, the rise of the light-emitting drive current applied to the pixels of the region AR2 is not sufficient. As a result, the luminance in the region AR2 decreases.

If the luminance of the background region Ag1 is relatively high as shown in FIG. 3B, the light-emitting drive current applied to the pixels of the region AR1 has a waveform indicated by a solid line in FIG. 4B and the light-emitting drive current applied to the pixels of the region AR2 has a waveform indicated by a broken line in FIG. 4B.

Specifically, the light-emitting drive current applied to the pixels of the scanning lines having high lighting ratios rises fast, so that the constant current is maintained for, e.g., the time period w8 corresponding to the 8/15 gradation. The light-emitting drive current applied to the pixels of the scanning lines having low lighting ratios rises slowly as in the case of FIG. 3A. However, if the current supply time becomes longer, there is generated a phenomenon that the light-emitting drive current overshoots beyond a constant current value. Due to this overshoot, the luminance in the region having the low lighting ratio increases.

As described above, luminance unevenness is generated due to the difference in the length of the scanning lines or the difference in the lighting ratio. In the present embodiment, to cope with these differences, the value of the constant current applied to the data lines DL is controlled at a scan timing of each of the scanning lines SL.

(3. Configuration and Operation of Display Driving Device)

The constant current drive control for the data lines DL will now be described in detail.

Figure 5:
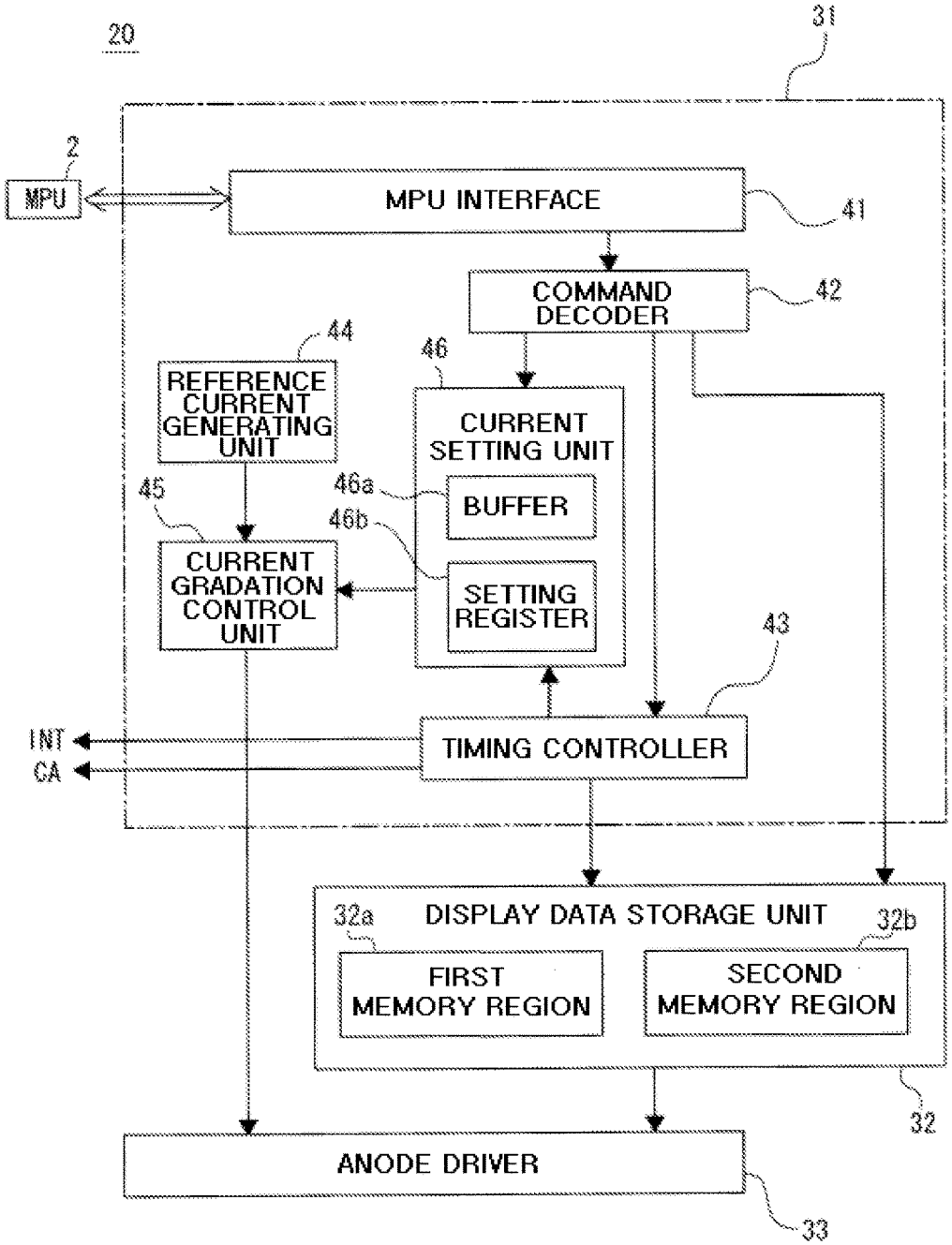
FIG. 5 is a block diagram of a controller IC in accordance with the embodiment.

FIG. 5 shows the inner parts of the controller IC 20 that serves as a display driving device. Particularly, the drive control unit 31 is shown in detail.

Within the drive control unit 31, there are provided an MPU interface 41, a command decoder 42, a timing controller 43, a reference current generating unit 44, a current gradation control unit 45 and a current setting unit 46.

The MPU interface 41 is an interface circuit unit for performing various kinds of communication with the MPU 2 described above. Specifically, the transmission and reception of display data and command signals are performed between the MPU interface 41 and the MPU 2.

The command decoder 42 records the command signal and the display data transmitted from the MPU 2 in an internal register (not shown) and performs decoding of the command signal. The command decoder 42 sends a necessary notice to the timing controller 43 so that the timing controller 43 can execute an operation according to the content of the recorded command signal. The command decoder 42 stores the recorded display data in the display data storage unit 32.

The display data storage unit 32 includes a first memory region 32*a* and a second memory region 32*b* as storage regions each storing the display data of one frame.

In the present embodiment, it is assumed that still image data of one frame are switched and displayed on the display unit 10. Specifically, the display data of one frame as a still image supplied from the MPU 2 is stored in, e.g., the first memory region 32*a*, and in this state, display is performed based on the stored display data.

Thereafter, when switching the displayed content, the next display data is stored in the second memory region 32*b* prior to a switching timing. At the switching timing, display drive is performed using the display data of the second memory region 32*b* as display target data.

Thereafter, when switching the displayed content, the next display data is stored in the first memory region 32*a* prior to the switching timing. At the switching timing, the display target data are changed to the display data of the first memory region 32*a*.

By alternately using the first memory region 32*a* and the second memory region 32*b* in this way, it is possible to smoothly perform the switching of the displayed content on the actual display without any delay time and without depending on the transmission time of the display data transmitted from the MPU 2.

The timing controller 43 sets the drive timing of the scanning lines SL and the data lines DL of the display unit 10.

Specifically, the timing controller 43 outputs the aforementioned cathode driver control signals CA to allow the cathode driver 21 to execute the line scanning.

Further, the timing controller 43 controls the transmission of the display data from the display data storage unit 32 to the anode driver 33 and controls such that a time period during which the anode driver 33 supplies a constant current to each of the data lines DL1 to DL128 at each scan timing becomes equal to a time period corresponding to the gradation of the corresponding pixel of the display data.

Furthermore, the timing controller 43 generates a frame start signal INT.

The reference current generating unit 44 generates a reference current which becomes a reference of a current value of a data line drive signal.

The current gradation control unit 45 adjusts the reference current generated in the reference current generating unit 44 to a predetermined current gradation value. Particularly, in the present embodiment, by adjusting the reference current by using the current gradation control unit 45, the value of the constant current applied to the respective data lines DL1 to DL128 can be changed at a scan timing of each of the scanning lines SL1 to SL96.

The adjustment of the constant current value by the current gradation control unit 45 is performed based on the current gradation values stored in the current setting unit 46. The current gradation values for the respective scanning lines SL1 to SL96 are stored in a setting register 46*b* of the current setting unit 46.

FIG. 6 shows one example of the current gradation values stored in the setting register 46*b*. The values of registers R1 to R6 shown in FIG. 6 are actually stored in the setting register 46*b*. The timings and the current gradation values are exemplified merely for the sake of description. The timings L1 to L96 refer to the scan timings of the scanning lines SL1 to SL96, respectively.

The current gradation values are set for the respective timings L1 to L96 that are the scan timings of the scanning lines SL. For example, the current gradation values are set to 3Fh (the numeral with "h" is a hexadecimal notation and the numeral in brackets is a decimal notation) for the timing L1, 3Ch for the timing L2, and so on. 6 bits of the current gradation value for each timing are stored in the registers R1 to R6 by one bit. That is to say, bit 0 of the 6-bit current gradation value is stored in the register R1, bit 1 in the register R2, . . . , bit 5 in the register R6.

Thus, the value of each of the registers R1 to R6 is composed of 1 bit. The values corresponding to the timings L1 to L96 are stored in the setting register 46*b*.

The whole setting register 46*b* of the current setting unit 46 shown in FIG. 5 stores 576 (96×6) bits as the current gradation value for one display data.

A buffer 46*a* of the current setting unit 46 is used to, when rewriting the current gradation values of the setting register 46*b*, temporarily store new current gradation values supplied from the MPU 2. For that reason, as in the setting register 46*b*, the buffer 46*a* is provided with regions of 576 (96×6) bits.

At a scan timing of each of the scanning lines SL1 to SL96, the current gradation control unit 45 obtains a constant current having a current value corresponding to the current gradation value of the corresponding scanning line stored in the setting register 46*b*. The constant current thus obtained is supplied to the anode driver 33.

The anode driver 33 supplies the constant current to each of the data lines DL1 to DL128 for the time period corresponding to the gradation value of each pixel indicated by the display data.

Figure 7:
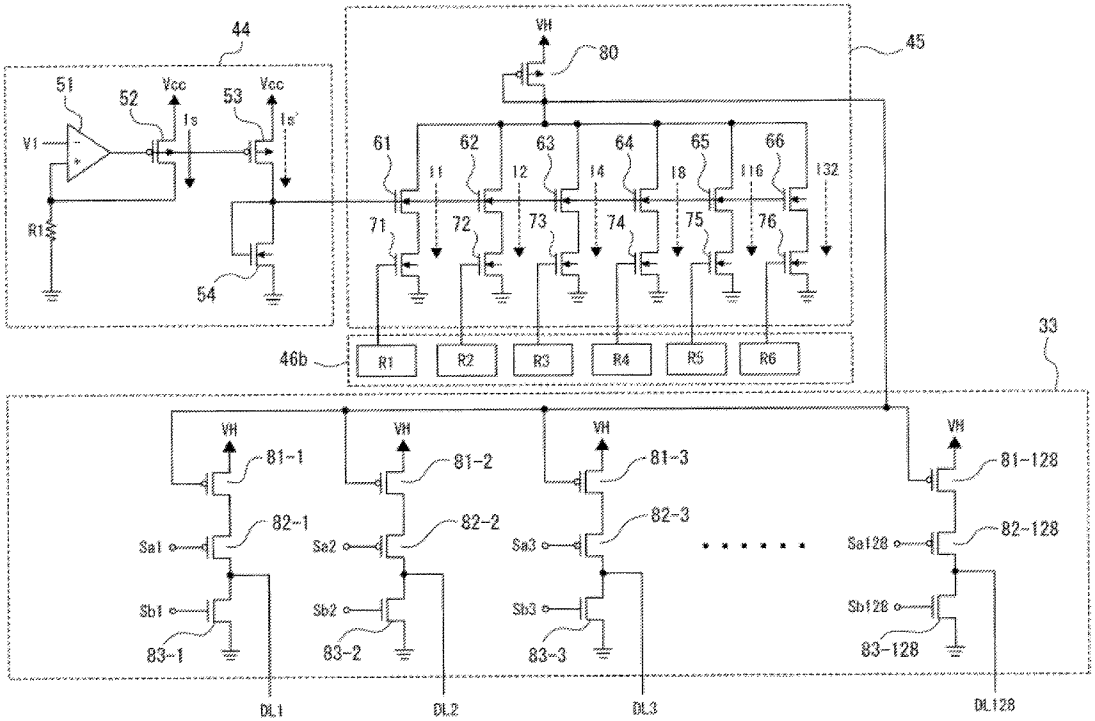
FIG. 7 is a circuit diagram of a constant current generating system in accordance with the embodiment.

FIG. 7 shows a circuit configuration example of the reference current generating unit 44, the current gradation control unit 45 and the anode driver 33.

The reference current generating unit 44 includes a differential amplifier 51, P-channel FETs (Field Effect Transistors) 52 and 53, an N-channel FET 54 and a resistor R1.

A predetermined voltage V1 is applied to an inverting input terminal of the differential amplifier 51. A non-inverting input terminal of the differential amplifier 51 is grounded via the resistor R1. The output terminal of the differential amplifier 51 is connected to a gate of the FET 52. A source of the FET 52 is connected to a voltage Vcc and a drain of the FET 52 is connected to the non-inverting input terminal of the differential amplifier 51. With this configuration, a reference current Is flows between the source and the drain of the FET 52.

A gate of the FET 53 is connected to the gate of the FET 52, a source of the FET 53 is connected to a voltage Vcc, and a drain of the FET 53 is connected to a drain and a gate of the FET 54. In this case, the FET 52 and the FET 53 employ a current mirror configuration. Thus, a reference current Is' having a current value equal to that of the reference current Is flows through the FET 53. Since the FETs 53 and 54 are serially connected to each other, the reference current Is' also flows between the drain and the source of the FET 54.

The current gradation control unit 45 includes N-channel FETs 61 to 66, N-channel FETs 71 to 76 and a P-channel FET 80.

A voltage VH is applied to a source of the FET 80. A drain and a gate of the FET 80 are connected to each other. The drain of the FET 80 is connected to all drains of the FETs 61 to 66. Sources of the FETs 61 to 66 are respectively connected to drains of the FETs 71 to 76.

In this case, the gates of the FETs 61 to 66 are connected to a connection point between the gate and the drain of the FET 54 of the reference current generating unit 44. Accordingly, each of the FET 54 and the FETs 61 to 66 employs a current mirror configuration.

In this regard, the FETs 61 to 66 are designed to have different transistor sizes (gate widths W) and thus are given current weights. Specifically, the gate widths W of the FETs 61 to 66 are 1 times, 2 times, 4 times, 8 times, 16 times and 32 times as large as the gate width of the FET 54, whereby the drain-source currents of the respective FETs 61 to 66 are weighted.

In other words, if the drain-source currents of the FETs 61 to 66 are assumed to be I1, I2, I4, I8, I16 and I32, respectively, I1 is equal to Is', I2 to 2·Is', I4 to 4·Is', I8 to 8·Is', I16 to 16·Is', and I32 to 32·Is'.

The FETs 71 to 76 serve as switches for the FETs 61 to 66. The voltages corresponding to the stored values of the registers R1 to R6 of the setting register 46*b* are respectively applied to the gates of the FETs 71 to 76. Accordingly, the FETs 71 to 76 are turned on or off by the current gradation values "1" or "0" shown in FIG. 6.

The weighted drain-source currents of the FETs 61 to 66 flow through turned-on FET system of the FETs 71 to 76. The current flowing through the FET 80 has a current value equal to the total sum of the weighted drain-source currents flowing through the turned-on FET system.

Referring again to FIG. 6, during the period of the timing L1, the FETs 71 to 76 are controlled by the values "111111" of the registers R1 to R6. In this case, all the FETs 71 to 76 are turned on. Accordingly, the source-drain current of the FET 80 becomes equal to the total sum of I1, I2, I4, I8, I16 and I32, which is a current value corresponding to the current gradation value 63.

During the period of the timing L2, the FETs 71 to 76 are controlled by the values "001111" of the registers R1 to R6. In this case, the FETs 71 and 72 are turned off, and the FETs 73 to 76 are turned on. Accordingly, the source-drain current of the FET 80 becomes equal to the total sum of I4, I8, I16 and I32, which is a current value corresponding to the current gradation value 60.

In the anode driver 33, data line driving circuits including P-channel FETs 81 (81-1 to 81-128) and 82 (82-1 to 82-128)) and N-channel FETs 83 (83-1-83-128) are formed in a corresponding relationship with the respective data lines DL1 to DL128. Circuit configurations that generate signals Sa (Sa1 to Sa128) and Sb (Sb1 to Sb128) for the gradation control (i.e. for the control of the length of the constant current output time) corresponding to the display data are omitted.

A voltage VH is applied to a source of the FET 81. A drain of the FET 81 is connected to a source of the FET 82. A drain of the FET 82 and a drain of the FET 83 are connected to each other. A source of the FET 83 is grounded. The connection point of the FETs 82 and 83 is connected to the data lines DL (DL1 to DL128).

In this case, the gates of the FETs 81-1 to 81-128 are connected to a connection point between the gate and the drain of the FET 80 of the current gradation control unit 45. Thus, each of the FET 80 and the FETs 81-1 to 81-128 employs a current mirror configuration. Accordingly, a constant current having a current value equal to that of the source-drain current of the FET 80 flows through the data line driving circuit for the respective data lines DL1 to DL128.

In this regard, the FETs 82-1 to 82-128 are turned on and off by the signals Sa (Sa1 to Sa128). The FETs 83-1 to 83-128 are turned on and off by the signals Sb (Sb1 to Sb128). The signals Sa and Sb are control signals for outputting a constant current for the time periods corresponding to the gradations of the pixels indicated by the display data and are pulse signals whose time periods are set based on the display data (the respective pixel data).

If the FET 82 is turned on and the FET 83 is turned off by the signals Sa and Sb, the drain current of the FET 82 is supplied to the data lines DL.

If the FET 82 is turned off and the FET 83 is turned on by the signals Sa and Sb, the data lines DL are grounded.

Since the signals Sa and Sb are generated based on the display data and the FETs 82 and 83 are controlled by the signals Sa and Sb, the constant current having the current value adjusted in the current gradation control unit 45 is outputted to the data lines DL for the time periods corresponding to the pixel gradation values indicated by the display data.

With this configuration, it is possible to realize the data line driving in which the current value is adjusted at the scan timing of each of the scanning lines SL1 to SL96.

Figure 8:
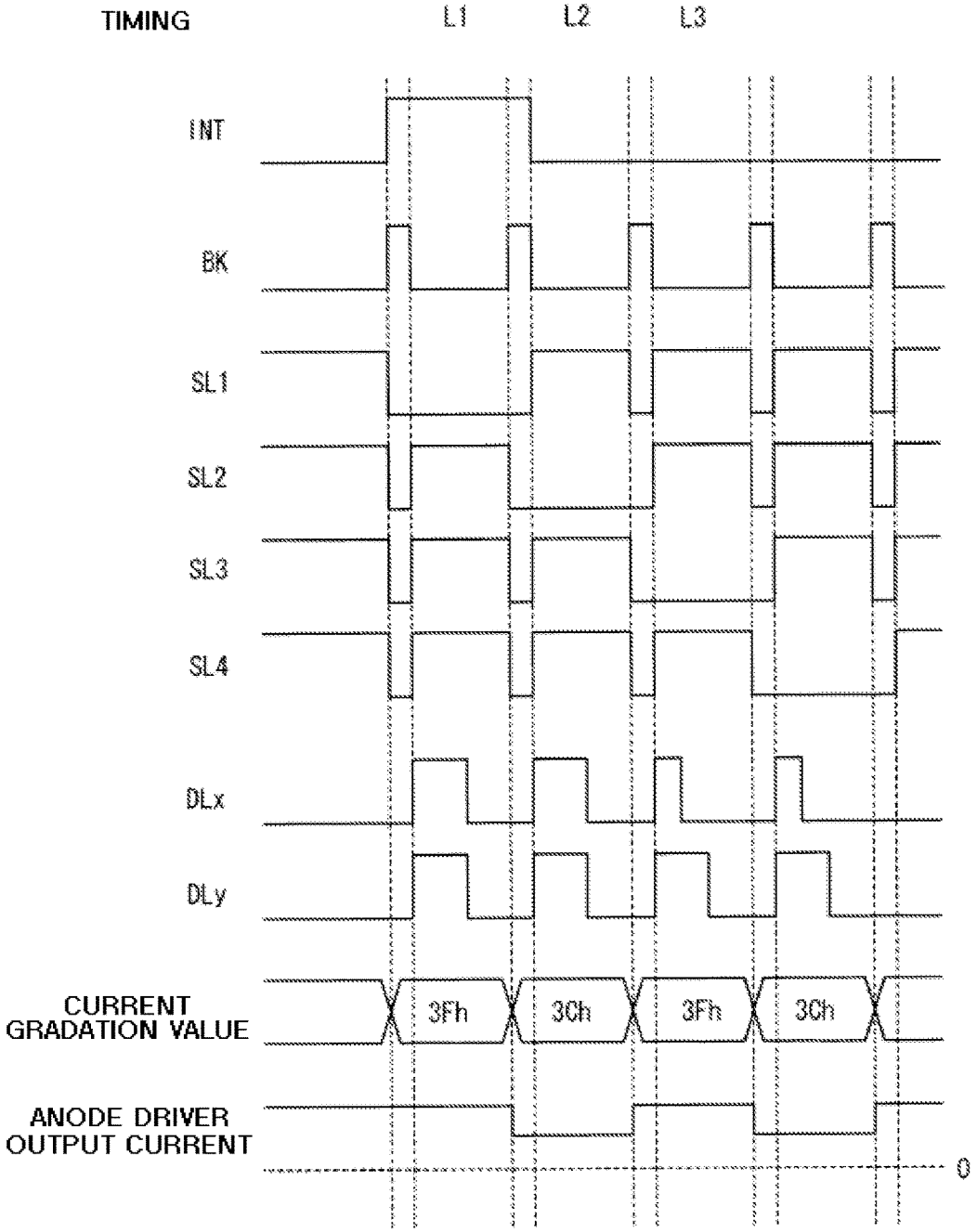
FIG. 8 is an explanatory view of the display driving operation waveforms in accordance with the embodiment.

FIG. 8 shows operation waveforms. The frame start signal INT becomes a high level (H level) in the first scanning line of a frame (at the scan timing of the scanning line SL1).

The blanking signal BK becomes an H level between the scan periods of the respective scanning lines SL1 to SL96. The H-level period of the blanking signal BK is a blanking period during which the pixels are not driven to emit light. During the blanking period, all the scanning lines SL are kept at a low level (L level) and all the data lines DL are grounded.

In FIG. 8, there are illustrated the scanning lines SL1 to SL4 of the scanning lines SL1 to SL96 and arbitrary data lines DLx and DLy of the data lines DL1 to DL128.

The scanning lines SL1 to SL4 sequentially come into a selection state from the frame start timing (The L level is a selected level). For example, the timing L1 is the scan timing of the scanning line SL1 and the timing L2 is the scan timing of the scanning line SL2.

While there is illustrated an example in which all the scanning lines SL are kept at an L level during the blanking period, it may be possible to employ a driving method in which all the scanning lines SL are kept at an H level during the blanking period.

At the respective scan timings, a constant current is outputted to the data lines DLx and DLy for the time periods corresponding to the gradation values of the pixels of the corresponding scanning line. The H-level periods of the data lines DLx and DLy shown in FIG. 8 indicate the periods during which a constant current flows through the data lines DLx and DLy.

If it is assumed that the current gradation values are set as in the example shown in FIG. 6, the constant current output from the anode driver 33 to the data lines DL1 to DL128 is variably controlled so as to have a current value of gradation 3Fh at the timing L1, a current value of gradation 3Ch at the timing L2 and a current value of gradation 3Fh at the timing L3, . . . , as indicated by an anode driver output current in FIG. 8.

Since the current value of the data lines DL are controlled at each scan timing in this way, it is possible to reduce or remove the luminance unevenness that has been described with reference to FIGS. 2A to 2C, 3A, 3B, and 4A to 4D.

If a difference exists in the length of the scanning lines SL due to the variant panel, the current gradation value is set high at the scan timing of the long scanning line SL and the current gradation value is set low at the scan timing of the short scanning line SL. Thus, by adjusting the current values of the data lines DL, it is possible to perform luminance correction to remove the luminance unevenness shown in FIG. 2C.

In the case where luminance unevenness is generated due to the difference in the lighting ratio in the respective scanning lines which depends on the screen content, the current gradation values suitable for the scan timings of the respective scanning lines are set depending on the difference in the lighting ratio and the pixel gradation values. For example, in the example shown in FIG. 3A, the current gradation value is set high because the luminance of the scanning lines to which the pixels of the region AR2 belong is decreased. In the example shown in FIG. 3B, the current gradation value is set low because the luminance of the scanning lines to which the pixels of the region AR2 belong is increased. In this way, the current value of the data lines DL at the scan timing of each of the scanning lines is adjusted depending on the screen content. This makes it possible to perform luminance correction to remove the luminance unevenness.

As indicated by the waveforms in FIG. 8, the switching of the constant current values outputted by the anode driver is performed during the blanking period defined by the blanking signal BK. During the blanking period, all the scanning lines SL are reset to an L level. During the blanking period, a constant current is not supplied from the anode driver 33 to the data lines DL. That is to say, during the blanking period, the signals Sa and Sb are generated such that the FETs 82 of the circuit shown in FIG. 7 is turned off and the FETs 83 are turned on.

The switching of the current gradation values applied to the gates of the FETs 71 to 76 of the current gradation control unit 45 is performed at the timing of the blanking signal BK.

The blanking period during which the supply of the current to the data lines DL is stopped with the scanning lines SL reset is the period during which the light emission for screen display is not performed. By performing the switching of the constant current values during this blanking period, it is possible to prevent the switching operation from affecting the quality of a displayed image. For example, the quality of a displayed image is prevented from being deteriorated by the transient current fluctuation during the switching of the current values.

(4. Switching of Displayed Image)

As for the luminance unevenness attributable to the difference in the scanning line length of a variant panel, the current gradation values stored in the setting register 46*b* may be fixed. That is to say, the current gradation values for, e.g., 6 bits×96 lines, stored in the setting register 46*b* need not be rewritten.

However, in the case of the luminance unevenness attributable to the difference in the lighting ratio, the current gradation values of the setting register 46*b* need to be rewritten in response to the switching of the display data, because the current gradation value suitable for each of the scanning lines varies depending on the image content.

Figure 9:
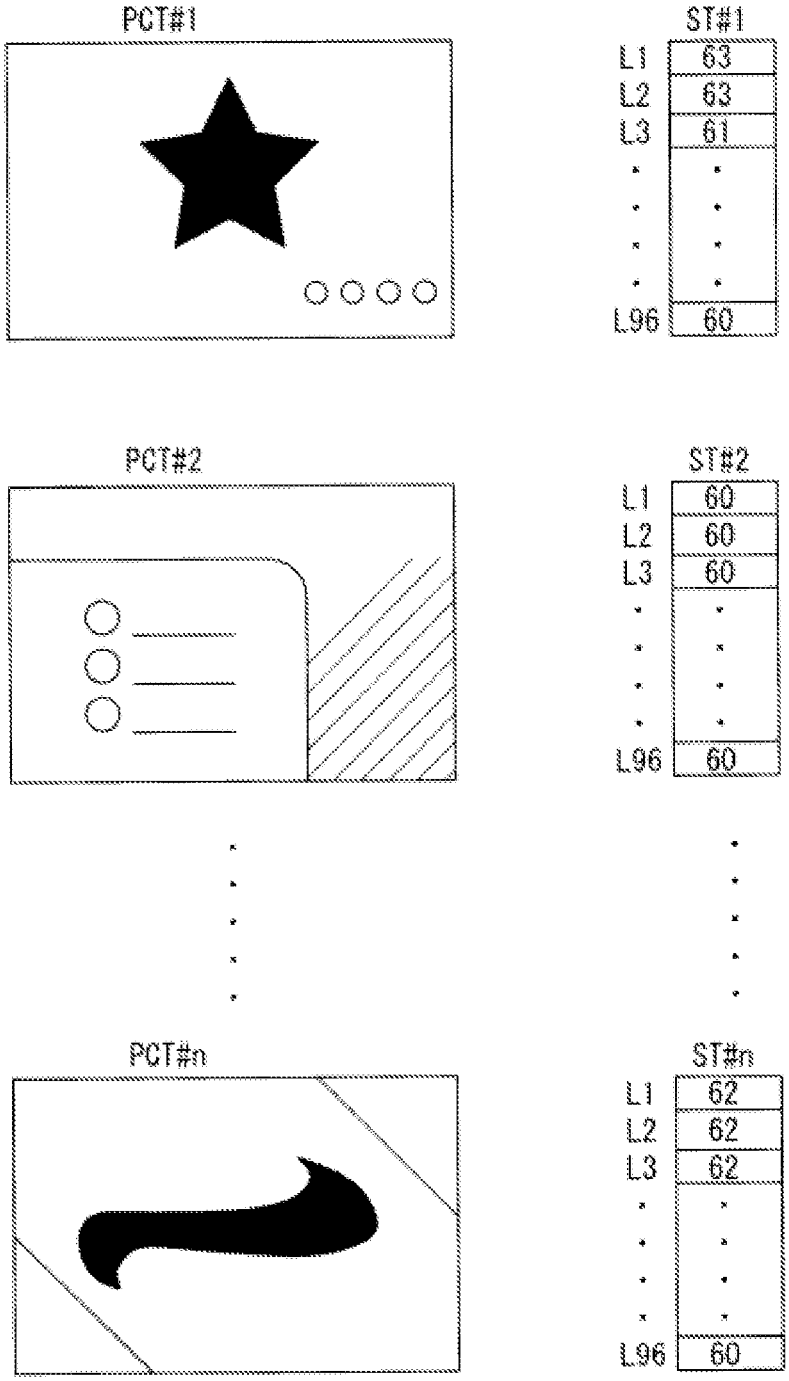
FIG. 9 is an explanatory view of the current gradation values depending on the display data in accordance with the embodiment.

For example, it is assumed that n kinds of images PCT#1 to PCT#n shown in FIG. 9 are displayed on the display apparatus of the present embodiment. The MPU 2 selects the display data as the images PCT#1 to PCT#n and supplies the selected display data to the controller IC 20, thereby allowing the controller IC 20 to execute a display operation.

In this case, for example, the MPU 2 holds the current gradation values ST#1 to ST#n corresponding to the images PCT#1 to PCT#n. Each of the current gradation values ST#1 to ST#n may be suitably preset for the respective scanning lines, depending on the images PCT#1 to PCT#n, and the current gradation values ST#1 to ST#n may be stored in the MPU 2.

The MPU 2 instructs the controller IC 20 to switch the current gradation value when switching the displayed image. For example, when transmitting the display data of the image PCT#2 to the controller IC 20 in order to display the image PCT#2, the current gradation value ST#2 is also transmitted to the controller IC 20. This enables the controller IC 20 to variably control the constant current values so as to appropriately reduce or remove the luminance unevenness depending on the image content.

The switching operation of the display image will be described with reference to FIGS. 10 and 11.

Figure 10:
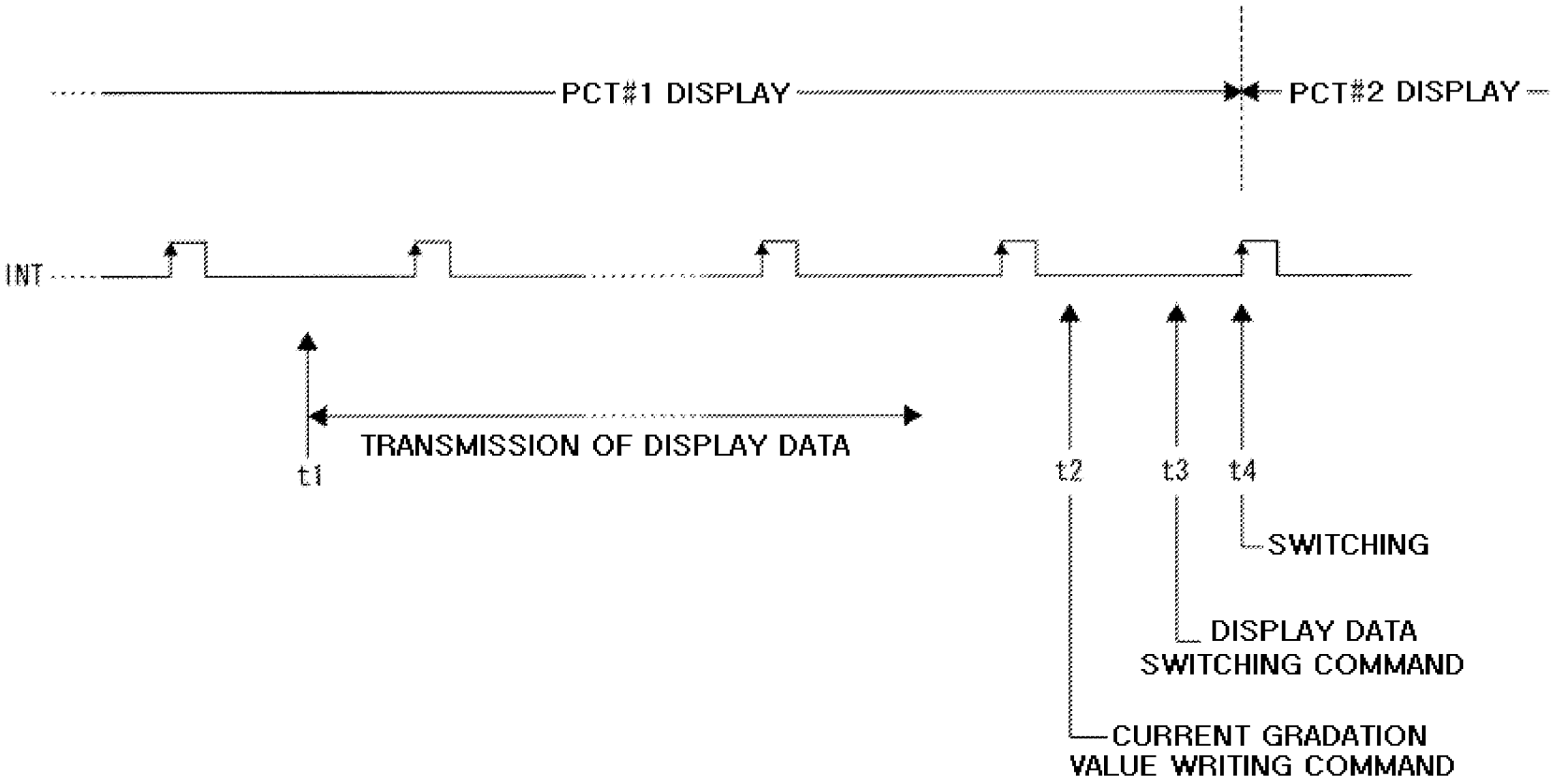
FIG. 10 is an explanatory view of a display data switching operation in accordance with the embodiment.

FIG. 10 schematically shows the operations of the MPU and the controller IC 20 when switching the displayed image. For example, it is assumed that the image PCT#1 is presently displayed and the image PCT#1 is to be switched to the image PCT#2.

The actual switching timing is a time point t4. Before the time point t4, the image PCT#1 is displayed by each frame started at the timing of the frame start signal INT.

In this case, prior to the time point t4 that is the switching timing, the MPU 2 transmits the display data of the image PCT#2 from an arbitrary time point t1. This is because the amount of the display data is large.

In the drive control unit 31 of the controller IC 20, the command decoder 42 records the transmitted display data and stores the display data in the display data storage unit 32. At this time, for example, if the display data of the image PCT#1 has been stored in the first memory region 32*a* and the anode driver 33 is operated in response thereto, the display data transmitted at the moment is stored in the second memory region 32*b*. Thus, the next display data can be recorded during the display of a certain image.

During the frame period just prior to the displayed image switching, the MPU 2 first transmits a current gradation value writing command at a time point t2. At this time, the MPU 2 also transmits the current gradation value ST#2 corresponding to the image PCT#2. The current gradation value is 6×96 bits and the data size thereof is not so large. Therefore, there is no need to transmit the current gradation value in advance.

In the drive control unit 31, the command decoder 42 writes the current gradation value ST#2 in the current setting unit 46 in response to the current gradation value writing command. In this case, the current gradation value ST#2 is written in the buffer 46*a*. The command decoder 42 notifies the reception of the current gradation value writing command to the timing controller 43.

Subsequently, the MPU 2 transmits a display data switching command at a time point t3. The command decoder 42 receives and decodes the display data switching command and notifies the command to the timing controller 43.

Since the actual switching of the display data is performed at the frame start timing, the timing controller waits until the timing of the frame start signal INT coming after the display data switching command. As for the process in response to the display data switching command thus received, the transmission source of the display data to be transmitted to the anode driver 33 is switched from the first memory region 32*a* to the second memory region 32*b* in the display data storage unit 32 at the timing (time point t4) at which the frame start signal INT is changed from an L level to an H level. At this time point, the timing controller 43 having received the current gradation value writing command controls, in response to the command, the current setting unit 46 to write the current gradation value ST#2, which has been previously stored in the buffer 46*a*, into the setting register 46*b*.

By virtue of this process, in the frame after the time point t4, the display of the image PCT#2 is performed. Further, at this time, the current value of the data lines DL is controlled based on the current gradation value ST#2 at the scan timing of each of the scanning lines SL. Needless to say, the current gradation value ST#2 is set for the respective scanning lines according to the image PCT#2. Thus, the luminance unevenness on the display is reduced or removed.

Figure 11:
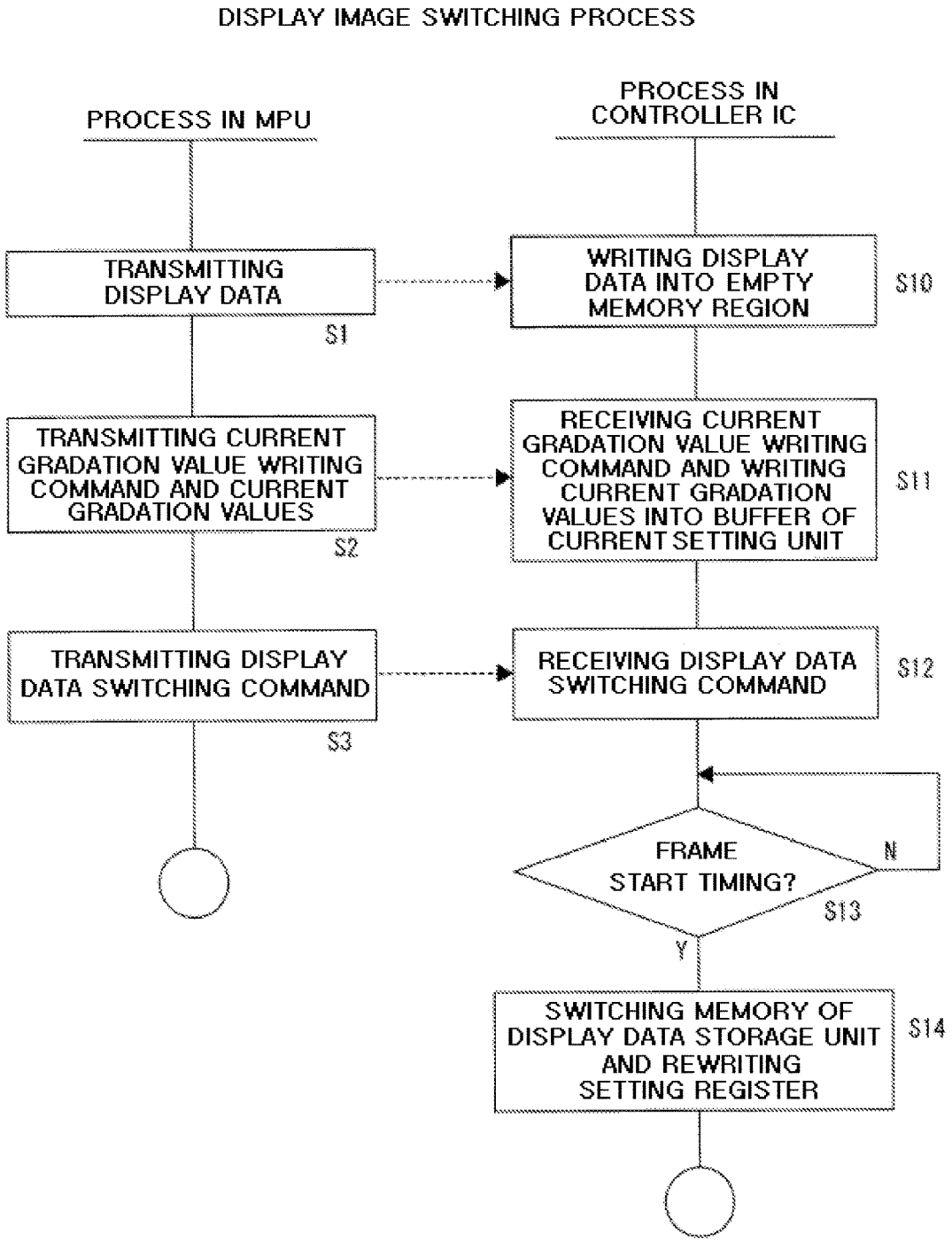
FIG. 11 is a flowchart of a display data switching process in accordance with the embodiment.

FIG. 11 shows the process in the MPU 2 and the process in the controller IC 20, which are implemented to perform the operations mentioned above.

In order to switch the displayed image, the MPU 2 transmits the display data of the next image in step S1. The controller IC 20 stores the transmitted display data in an empty one of the first and second memory regions 32*a* and 32*b* of the display data storage unit 32 in step S10.

If the transmission of the display data is completed, the MPU 2 transmits a current gradation value writing command and a current gradation value in step S2. In step S11, the controller IC 20 receives the current gradation value writing command and writes the transmitted current gradation value into the buffer 46*a* of the current setting unit 46.

During the same frame period, the MPU 2 transmits a display data switching command in step S3. The controller IC 20 receives the display data switching command in step S12.

In step S13, the controller IC 20 waits until the frame start timing. At the frame start timing, in step S14, the controller IC 20 implements a process in response to the display data switching command and the current gradation value writing command. That is to say, as described above, the transmission source of the display data to be transmitted to the anode driver 33 is switched between the first memory region 32*a* and the second memory region 32*b*. The current gradation value stored in the buffer 46*a* of the current setting unit 46 is written into the setting register 46*b*.

(5. Effects of the Embodiment and Modified Examples)

In the embodiment described above, the controller IC 20 as a display driving device performs display drive based on display data with respect to a display unit which includes data lines each connected to a plurality of pixels arranged in a column direction and scanning lines each connected to a plurality of pixels arranged in a row direction, the pixels arranged at respective intersections of the data lines and the scanning lines. The controller IC 20 includes: a current setting unit 46 configured to store current gradation values which are set for the respective scanning lines that constitute a frame of the display data; a current gradation control unit 45 configured to, at each of scan timings for the respective scanning lines within one frame, generate a constant current corresponding to a current gradation value for a corresponding scanning line among the current gradation values stored in the current setting unit; and an anode driver 33 (data line driving unit) configured to supply the constant current generated by the current gradation control unit to the respective data lines for time periods corresponding to pixel gradation values defined by the display data.

With this configuration, the value of the constant current applied to each of the data lines DL is controlled at a scan timing of each of the scanning lines SL. Accordingly, the constant current value for each of the scanning lines is suitably set and stored as a current gradation value capable of removing luminance unevenness. Consequently, it is possible to remove or reduce the luminance unevenness attributable to the lighting ratios or the light emission gradations of the respective scanning lines or the luminance unevenness attributable to the difference in the lengths of the respective scanning lines SL of a variant panel. Moreover, it is possible to improve the quality of a displayed image. In the case of a variant panel, it goes without saying that the luminance unevenness generated due to the difference in the lighting ratios of the respective lines can be corrected by the aforementioned method. It is preferable that the current gradation values are set on an image-by-image basis as in a typical rectangular panel.

Further, the current gradation control unit 45 performs switching of the current gradation values during a blanking period between scan periods of the respective scanning lines. This makes it possible to prevent the variation of the constant current flowing through the data lines DL from affecting the displayed image. It is therefore possible to keep the image at a high quality.

Further, the current gradation values stored in the current setting unit 46 (setting register 46*b*) are set to be rewritten in response to a switching of the display data displayed on the display unit. The lighting ratios of the respective scanning lines within one frame differ from image to image. Therefore, the optimal current gradation values of the respective scanning lines for suitably correcting the luminance unevenness vary depending on the image content. By preparing the current gradation values corresponding to the image to be displayed and rewriting the current gradation values in response to the switching of the display data, it is possible to suitably correct the luminance unevenness at all times.

In this case, rewriting of the current gradation values is performed at a frame start timing. Since the switching of the displayed image is performed at the frame start timing, it is the best to rewrite the current gradation values at the same time so as to obtain the luminance unevenness correcting effect.

Further, as shown in FIG. 7, the current gradation control unit 45 selects one or more transistors (FETs 61 to 66) having differently-weighted current values based on the current gradation value for the corresponding scanning line and generates, as the constant current corresponding to the current gradation value, a current (drain-source current of FET 80) equal to a total sum of current values flowing in the selected transistors. By selecting the transistors depending on the current gradation values in this way, it is possible to easily generate a constant current corresponding to the current gradation values. This is suitable for driving the data lines in accordance with the present embodiment.

The display apparatus 1 of the present embodiment provided with the controller IC 20 can realize high-quality display by reducing or removing the luminance unevenness.

While one embodiment of the present invention has been described above, the display apparatus, the display driving device and the display driving method of the present invention are not limited to the aforementioned embodiment but may be modified in many different forms.

As for the setting register 46*b* for storing the current gradation values, it may be possible to use a register configuration having an actual hardware form or a memory such as a D-RAM (Dynamic Random Access Memory), an S-RAM (Static Random Access Memory), a flash memory or the like. In the case where it is not necessary to rewrite the current gradation values in order to cope with a variant panel, the function of the setting register 46*b* may be realized by a ROM (Read Only Memory).

The current gradation values ST#1 to ST#n corresponding to various kinds images PCT#1 to PCT#n described with reference to FIG. 9 are stored in the MPU 2 and are transmitted to the controller IC 20 if such a need arises.

Alternatively, the current gradation values ST#1 to ST#n may be stored within the controller IC 20. In that case, the controller IC 20 is configured to select the current gradation value in response to the switching of the display data and to write the selected current gradation value into the setting register 46*b*.

The present invention can be applied to not only the display apparatus which makes use of an OLED but also other display apparatuses. Particularly, the present invention is very suitable for a display apparatus which makes use of a self-luminous element driven by a current.

While the invention has been shown and described with respect to the embodiments, it will be understood by those skilled in the art that various changes and modifications may be made without departing from the scope of the invention as defined in the following claims.

What is claimed is:

1. A display driving device for performing display drive based on display data with respect to a display unit which includes data lines each connected to a plurality of pixels arranged in a column direction and scanning lines each connected to a plurality of pixels arranged in a row direction, the pixels arranged at respective intersections of the data lines and the scanning lines, the display driving device comprising:

a current setting unit including a setting register configured to store current gradation values which are set for the respective scanning lines that constitute a frame of the display data, and a buffer configured to store next current gradation values to be stored in the setting register;

a current gradation control unit configured to, at each of scan timings for the respective scanning lines within one frame, generate a constant current corresponding to a current gradation value for a corresponding scanning line among the current gradation values stored in the setting register of the current setting unit; and a data line driving unit configured to supply the constant current generated by the current gradation control unit to the respective data lines for time periods corresponding to pixel gradation values defined by the display data, wherein the current gradation values stored in the setting register are set to be rewritten by the next current gradation values stored in the buffer in response to a switching of the display data displayed on the display unit; and wherein the current gradation control unit selects one or more transistors having differently-weighted current values based on the current gradation value for the corresponding scanning line and generates, as the constant current corresponding to the current gradation value, a current equal to a total sum of current values flowing in the selected transistors.

2. The display driving device of claim 1, wherein the current gradation control unit performs switching of the current gradation values during a blanking period between scan periods of the respective scanning lines.

3. The display driving device of claim 2, wherein rewriting of the current gradation values stored in the setting register of the current setting unit is performed at a frame start timing.

4. The display driving device of claim 3, wherein the current gradation control unit selects one or more transistors having differently-weighted current values based on the current gradation value for the corresponding scanning line and generates, as the constant current corresponding to the current gradation value, a current equal to a total sum of current values flowing in the selected transistors.

5. The display driving device of claim 2, wherein the current gradation control unit selects one or more transistors having differently-weighted current values based on the current gradation value for the corresponding scanning line and generates, as the constant current corresponding to the current gradation value, a current equal to a total sum of current values flowing in the selected transistors.

6. The display driving device of claim 1, wherein rewriting of the current gradation values stored in the setting register of the current setting unit is performed at a frame start timing.

7. The display driving device of claim 6, wherein the current gradation control unit selects one or more transistors having differently-weighted current values based on the current gradation value for the corresponding scanning line and generates, as the constant current corresponding to the current gradation value, a current equal to a total sum of current values flowing in the selected transistors.

8. The display driving device of claim 1, wherein the buffer stores the next current gradation values which are set for the respective scanning lines that constitute a frame of next display data prior to a frame start timing for switching of the display data, and the current gradation values stored in the setting register are rewritten by the next current gradation values stored in the buffer at the frame start timing by a display data switching command after the buffer stores the next current gradation values.

9. A display driving method for performing display drive based on display data with respect to a display unit which includes data lines each connected to a plurality of pixels arranged in a column direction and scanning lines each connected to a plurality of pixels arranged in a row direction, the pixels arranged at respective intersections of the data lines and the scanning lines, the method comprising:

storing current gradation values in a current setting unit including a setting register configured to store current gradation values which are set for the respective scanning lines that constitute a frame of the display data and a buffer configured to store next current gradation values to be stored in the setting register;

generating, at each of scan timings for the respective scanning lines within one frame, a constant current corresponding to a current gradation value for a corresponding scanning line among the current gradation values stored in the setting register;

supplying the generated constant current to the respective data lines for time periods corresponding to pixel gradation values defined by the display data; and rewriting the current gradation values stored in the setting register by the next current gradation values stored in the buffer in response to a switching of the display data displayed on the display unit;

wherein one or more transistors having differently-weighted current values are selected based on the current gradation value for the corresponding scanning line and a current equal to a total sum of current values flowing in the selected transistors is generated as the constant current corresponding to the current gradation value.

10. The display driving method of claim 9, further comprising:

writing the next current gradation values, which are set for the respective scanning lines that constitute a frame of next display data, in the buffer prior to a frame start timing for switching of the display data, and wherein the current gradation values stored in the setting register are rewritten by the next current gradation values stored in the buffer at the frame start timing by a display data switching command after writing the next current gradation values in the buffer.

11. A display apparatus, comprising:

a display unit including data lines each connected to a plurality of pixels arranged in a column direction and scanning lines each connected to a plurality of pixels arranged in a row direction, the pixels arranged at respective intersections of the data lines and the scanning lines;

a scanning line driving unit configured to apply a scanning line drive signal to the scanning lines;

a current setting unit including a setting register configured to store current gradation values which are set for the respective scanning lines that constitute a frame of display data and a buffer configured to store next current gradation values to be stored in the setting register;

a current gradation control unit configured to, at each of scan timings for the respective scanning lines within one frame, generate a constant current corresponding to a current gradation value for a corresponding scanning line among the current gradation values stored in the setting register of the current setting unit; and a data line driving unit configured to supply the constant current generated by the current gradation control unit to the respective data lines for time periods corresponding to pixel gradation values defined by the display data wherein the current gradation values stored in the setting register are set to be rewritten by the next current gradation values stored in the buffer in response to a switching of the display data displayed on the display unit;

wherein the current gradation control unit selects one or more transistors having differently-weighted current values based on the current gradation value for the corresponding scanning line and generates, as the constant current corresponding to the current gradation value, a current equal to a total sum of current values flowing in the selected transistors.

12. The display apparatus of claim 11, wherein the buffer stores the next current gradation values which are set for the respective scanning lines that constitute a frame of next display data prior to a frame start timing for switching of the display data, and the current gradation values stored in the setting register are rewritten by the next current gradation values stored in the buffer at the frame start timing by a display data switching command after the buffer stores the next current gradation values.

* * * * *